US007018018B2

(12) United States Patent
Kim

(10) Patent No.: US 7,018,018 B2
(45) Date of Patent: Mar. 28, 2006

(54) PRINT HEAD OF AN INK-JET PRINTER AND FABRICATION METHOD THEREOF

(75) Inventor: Jin-hyun Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 63 days.

(21) Appl. No.: 10/656,243

(22) Filed: Sep. 8, 2003

(65) Prior Publication Data

US 2004/0075714 A1 Apr. 22, 2004

(30) Foreign Application Priority Data

Oct. 17, 2002 (KR) ..... 10-2002-0063571

(51) Int. Cl.
*B41J 2/05* (2006.01)

(52) U.S. Cl. ..... 347/58; 347/63

(58) Field of Classification Search ..... 347/61–65, 347/67, 56–59, 20
See application file for complete search history.

(56) References Cited

U.S. PATENT DOCUMENTS 5,122,812 A * 6/1992 Hess et al. ..... 347/59

* cited by examiner

*Primary Examiner*—Juanita D. Stephens
(74) *Attorney, Agent, or Firm*—Staas & Halsey LLP

(57) ABSTRACT

A print head of an ink-jet printer including a main chip area having at least one ink jetting portion disposed on a substrate to jet ink, and at least one bonding pad connected with a corresponding lead end of a wiring of a circuit part to control the ink jetting portion; and a scribe lane area disposed around the main chip area and forming a cutting region in which the main chip area is divided from main chip areas of other print heads by cutting, the scribe lane area having a damping pattern portion formed to be electrically and physically isolated from the main chip area and the substrate.

24 Claims, 10 Drawing Sheets

PRINT HEAD OF AN INK-JET PRINTER AND FABRICATION METHOD THEREOF

CROSS-REFERENCE TO RELATED APPLICATIONS

This application claims the benefit of Korean Application No. 2002-63571, filed Oct. 17, 2002, in the Korean Intellectual Property Office, the disclosure of which is incorporated herein by reference.

BACKGROUND OF THE INVENTION

1. Field of the Invention

The present invention relates to a print head of an ink-jet printer and a fabrication method thereof, and, more particularly, to a print head of an ink-jet printer, and a fabrication method thereof, having a damping pattern portion formed in a scribe lane area to prevent damage of a head chip from being generated by a wiper or an external impact during printing, and to prevent a short circuit from being generated between a substrate and lead ends of a wiring of a circuit part due to a compression impact and the like occurring during printing and/or when the lead ends are bonded with bonding pads in a main chip area of the head chip.

2. Description of the Related Art

Generally, as shown in FIG. 1, an ink-jet printer has a print head 1 fixed on an ink cartridge 10 to send and receive an electric signal to and from a printer body through a contact pad 36.

The print head 1 includes a head chip 20 having a plurality of ink jetting portions, and a circuit part 30 driving and controlling each of the ink jetting portions. Each of the ink jetting portions is composed of a heater 25 (FIG. 3) and an ink jetting nozzle 24 to generate ink bubbles, and the circuit part 30 is composed of a flexible printed circuit board in which a wiring 34 and/or switching circuits are formed to drive and control each of the ink jetting portions.

The head chip 20 is provided with a silicon substrate 21 having the heaters 25 and bonding pads 26 formed on an upper surface thereof, a chamber plate 37 disposed on the substrate 21 to define ink chambers 29, and a nozzle plate 23 disposed over the ink chambers 29 and having ink jetting nozzles 24. The bonding pads 26 are bonded with lead ends 32 of the wirings 34 of the circuit part 30.

To supply ink from the ink cartridge 10 into each of the ink chambers 29, an ink supplying manifold 22 is formed to penetrate the substrate 21 from a lower surface thereof to an upper surface thereof.

The substrate 21 on which the chamber plate 37 and the nozzle plate 23 are formed is adhered to a substrate-mounting groove 14 of the ink cartridge 10 by adhesives 50.

The operation of the print head 1 constructed as above will be explained below. First, an ink supplied through an ink supplying hole 12 of the ink cartridge 10 moves into the ink chambers 29 defined by the chamber plate 37 and the nozzle plate 23 through the ink supplying manifold 22 from the lower surface of the substrate 21.

After temporarily remaining in the ink chambers 29, the ink is heated in an instant by heat generated by the heaters 25.

As a result, the ink generates explosive bubbles, and thereby a portion of the ink in the ink chambers 29 is jetted outside the print head 1 through the ink jetting nozzles 24 formed over the ink chambers 29 to form an image on paper.

However, such a conventional print head 10 has the structure that the bonding pads 26 formed on the substrate 21 are adhered to corresponding lead ends 32 of the wiring 34 of the circuit part 30 by piezoelectric bonding.

Accordingly, when the lead ends 32, which are usually formed of copper, are piezoelectrically bonded with the bonding pads 26, which are usually formed of aluminum, the lead ends 32 compress and push an insulating layer 39 in a scribe lane area of the head chip 20.

Thus, when the insulating layer 39 in the scribe lane area is pushed by the lead ends 32, it may be damaged by forming compressed traces 46 at a cutting surface 45, as shown in FIG. 5.

In this state, after being fixed on the ink cartridge 10, the print head 1 is operated to carry out printing operations, and the damaged insulating layer 39 in the scribe lane area is more compressed and fatigued with continuous stress caused by wiping and the like, and, as a result, the lead end 32 comes into contact with the grounded silicon substrate 21 to generate a short circuit.

Also, the conventional print head 10 has the bonding pads 26, each having the structure in which a contact plug 28 is connected with a lower metal 27 through a wide via hole 42 formed in an interlayer dielectric layer 41 therebetween, and thereby the contact plug 28 has a wide and flat recess 28*a* at an upper surface thereof, as shown in FIG. 4.

Therefore, in piezoelectric bonding, one or more lead ends 32 may not be adhered with the corresponding contact plugs 28 of the bonding pads 26 well, so that bonding therebetween is poor.

In this state, when a wiper frequently contacts the poorly adhered lead ends 32 to wipe the print head 1 during a wiping operation, the poorly adhered lead ends 32 may be detached from the corresponding contact plugs 28, causing the corresponding ink jetting portion to not jet ink, thereby resulting in poor printing.

Further, the conventional print head 10 has the structure in that the ink supplying manifold 22 penetrates the substrate 21, so that the substrate 21 of the head chip 20 is mechanically weak. Therefore, even when a small impact is imparted on the substrate 21, the substrate 21 may be cracked centering on the ink supplying manifold 22.

Also, the conventional print head 10 presents a problem in that heat generated in the head chip 20 by the heaters 25 and the like during printing is not radiated outside through the ink cartridge 10, but accumulated in the head chip 20, thereby shortening the life span thereof, or deteriorating the ink jetting efficiency thereof.

SUMMARY OF THE INVENTION

It is, therefore, an aspect of the present invention to provide a print head of an ink-jet printer, and a fabrication method thereof, having a damping pattern portion formed at an outer area of a head chip to prevent a short circuit from being generated between a substrate and lead ends of a wiring of a circuit part due to a compression impact occurring during printing and/or when the lead ends are bonded with bonding pads of the head chip.

It is another aspect of the present invention to provide a print head of an ink-jet printer, and a fabrication method thereof, which can adhere lead ends of a wiring of a circuit part fixedly to bonding pads of a head chip so as not to make a poor bond therebetween.

It is still another aspect of the present invention to provide a print head of an ink-jet printer, and a fabrication method thereof, which has mechanical strength sufficient to prevent damage to the head chip from being generated by a wiper or an external impact during printing operations, including wiping.

It is still another aspect of the present invention to provide a print head of an ink-jet printer, and a fabrication method thereof, which can efficiently remove heat generated from a head chip during printing.

Additional aspects and/or advantages of the invention will be set forth in part in the description which follows and, in part, will be obvious from the description, or may be learned by practice of the invention.

These and/or other aspects are provided, according to one aspect of an embodiment of the present invention, by a print head of an ink-jet printer, comprising a main chip area having at least one ink jetting portion disposed on a substrate to jet ink and at least one bonding pad connected with a corresponding lead end of a wiring of a circuit part to control the ink jetting portion, and a scribe lane area disposed around the main chip area and forming a cutting region in which the main chip area is divided from main chip areas of other print heads by cutting, the scribe lane area having a damping pattern portion formed to be electrically and physically isolated from the main chip area and the substrate.

In an embodiment of the present invention, the damping pattern portion may comprise at least one insulating layer formed on the substrate, and at least one reinforce pattern formed on the insulating layer.

The insulating layer may comprise an isolation layer formed on the substrate, and a first interlayer dielectric layer formed on the isolation layer, and the reinforce pattern may comprise two reinforce patterns formed to have an interlayer dielectric layer therebetween. Also, the reinforce pattern may be formed of the same material as the bonding pad.

The damping pattern portion may further include at least one protection layer formed on the reinforce pattern.

The protection layer may comprise a passivation layer formed on the reinforce pattern, and a chamber/nozzle plate layer formed on the passivation layer in the main chip area forming an ink chamber and a nozzle constituting the ink jetting portion.

Also, the damping pattern portion may be disposed at both sides of the scribe lane area adjacent to a pad region of the main chip area in which the bonding pad is installed. Alternatively, the damping pattern portion may be disposed at four sides of the scribe lane area.

To facilitate bonding with the bonding pad, the lead end of the wiring may be bonded with a sidewall of a recess formed on an upper surface of the bonding pad.

According to another aspect of an embodiment of the present invention, there is provided a fabrication method of a print head comprising forming a damping pattern portion in a scribe lane area to be electrically and physically isolated from a main chip area and a substrate.

The forming the damping pattern portion may comprise forming at least one insulating layer in the scribe lane area, and forming at least one reinforce pattern on the insulating layer.

The forming the insulating layer may comprise forming an isolation layer on the substrate, and forming a first interlayer dielectric layer on the isolation layer.

The forming the reinforce pattern may comprise forming a first reinforce pattern on the first interlayer dielectric layer, forming a second interlayer dielectric layer over the substrate over which the first reinforce pattern is formed, and forming a second reinforce pattern on the second interlayer dielectric layer.

The forming the reinforce pattern may be carried out together with the forming at least one bonding pad connected with a corresponding lead end of a wiring of a circuit part in the main chip area to control an ink jetting portion formed on the substrate to jet ink.

The forming the first and second reinforce patterns may further comprise depositing first and second metal layers, respectively, when forming the first and second reinforce patterns, and patterning the first and second metal layers by using photo resists as masks.

The forming the bonding pad may comprise forming a wide via hole in the second interlayer dielectric layer, after forming the second interlayer dielectric layer, to form a wide recess on an upper surface of the second metal layer forming a portion of the bonding pad.

The forming the damping pattern portion may further comprise forming at least one protection layer on the second reinforce pattern.

The forming the protection layer may comprise forming a passivation layer on the uppermost reinforce pattern, and forming a chamber/nozzle plate layer on the passivation layer when it is formed in the main chip area to form an ink chamber and a nozzle constituting the ink jetting portion.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
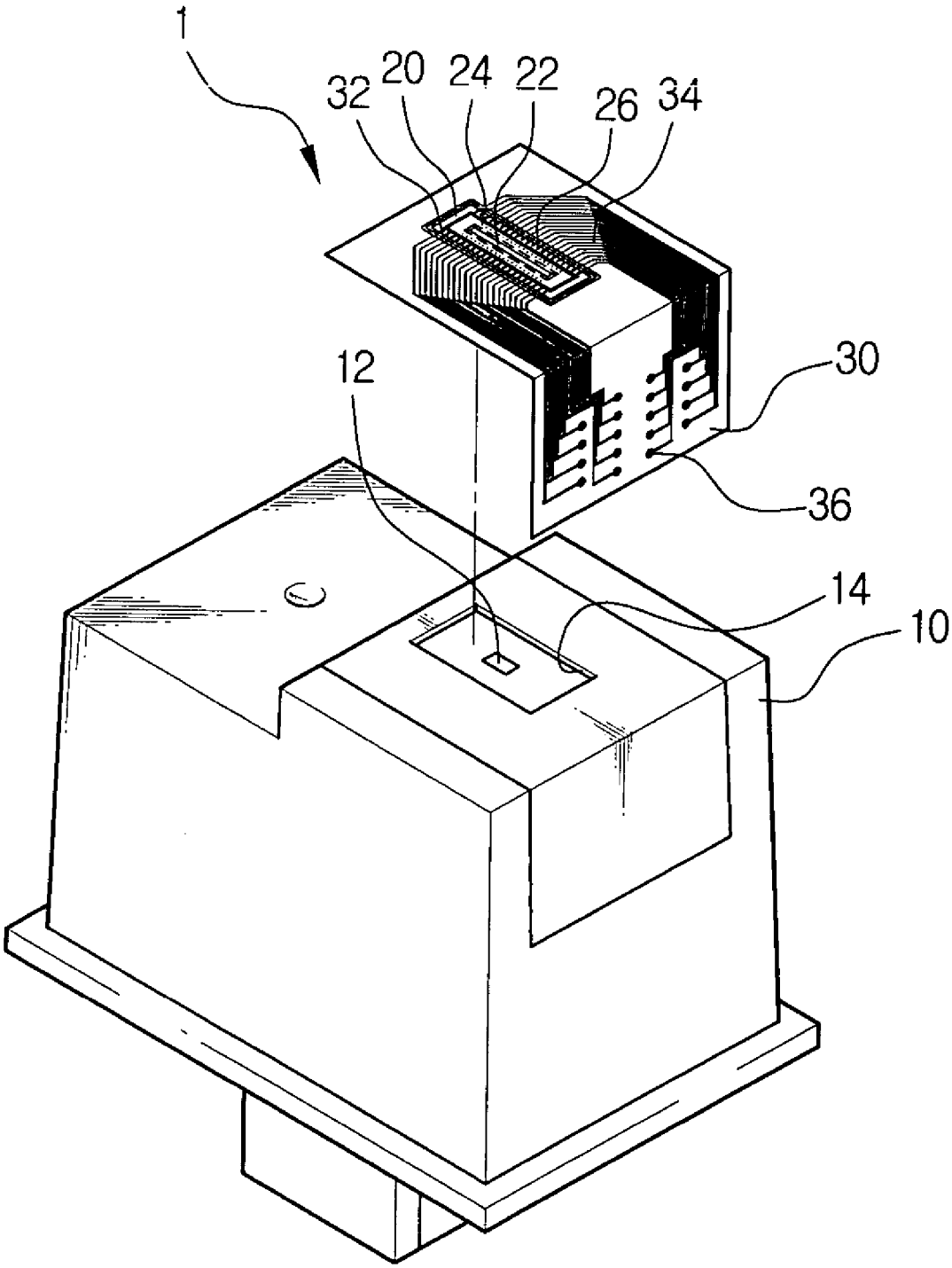
FIG. 1 (PRIOR ART)
FIG. 1 is an exploded view illustrating a combination of a print head and an ink cartridge in a conventional ink-jet printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 6:
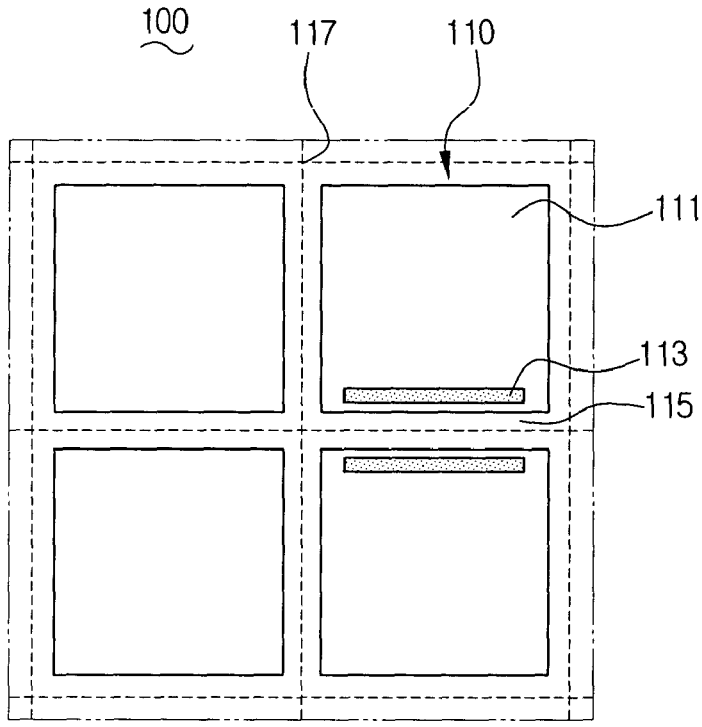
FIG. 6 is a top plan view illustrating a wafer having a plurality of head chips fabricated thereon, each forming a portion of a print head in accordance with an embodiment of the present invention.

Referring now to FIG. 6, there is partially and schematically illustrated a wafer 100 having several tens through several hundreds of head chips 110 fabricated thereon, each of which forms a portion of a print head in accordance with an embodiment of the present invention.

Figure 2:
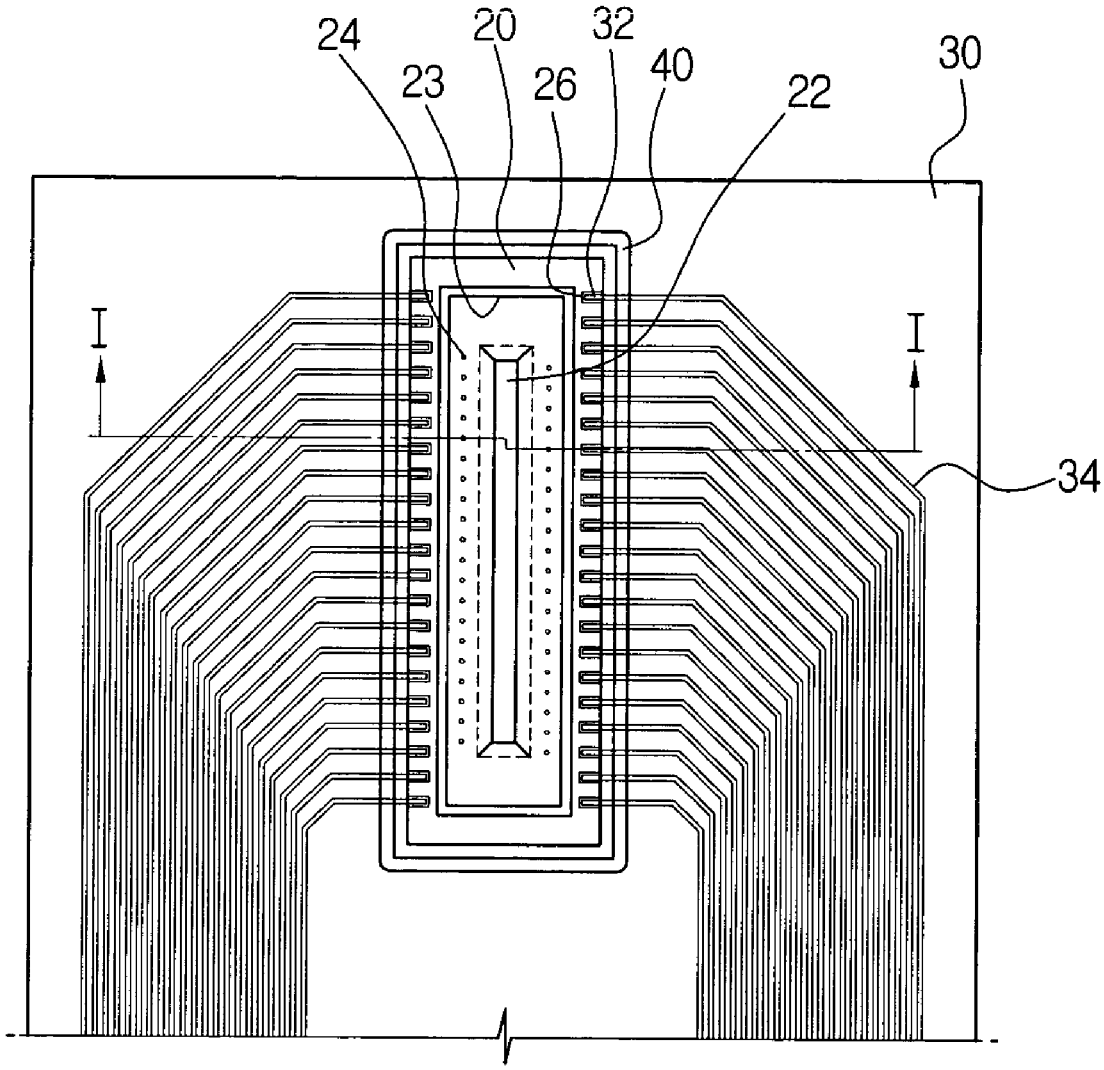
FIG. 2 (PRIOR ART)
FIG. 2 is a partial top plan view of the print head shown in FIG. 1.
Figure 3:
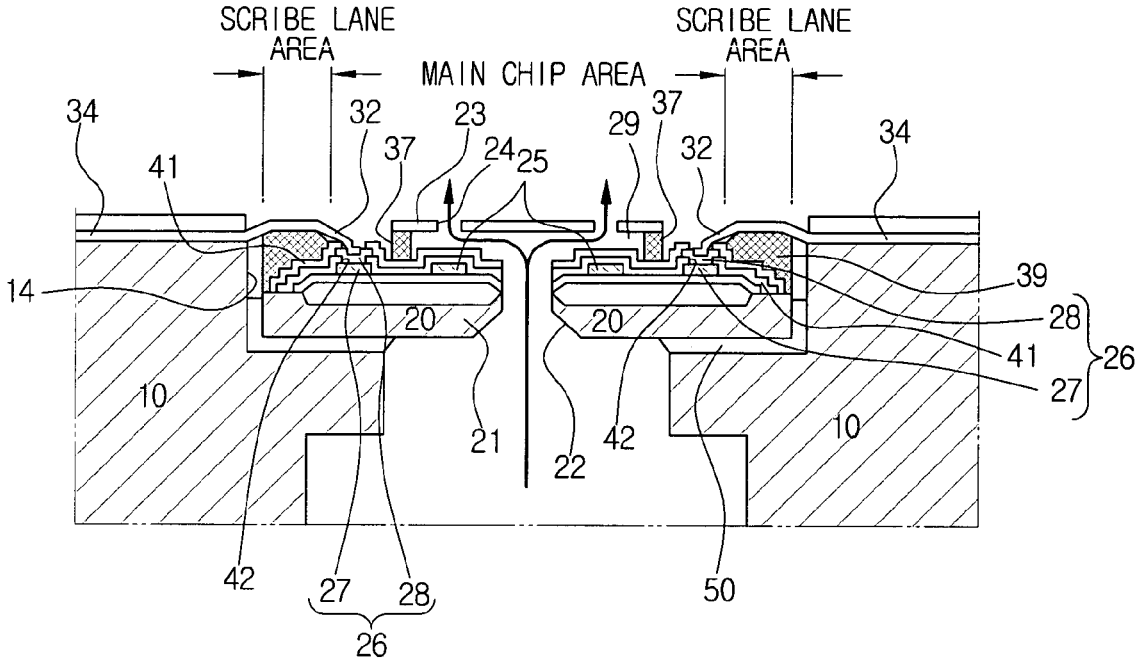
FIG. 3 (PRIOR ART)
FIG. 3 is a partial cross-sectional view of the print head taken along line I—I of FIG. 2.
Figure 4:
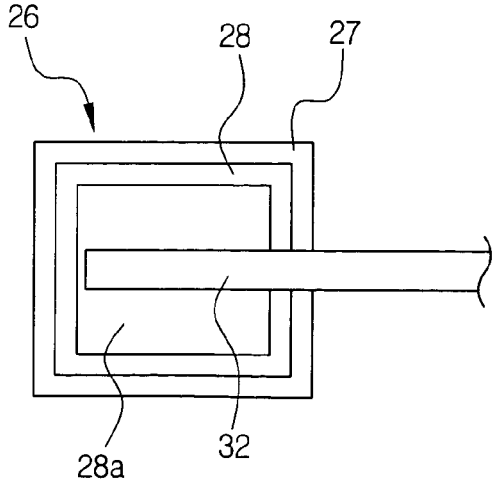
FIG. 4 (PRIOR ART)
FIG. 4 is a partial top plan view illustrating a bonding state between a bonding pad of a head chip and a lead end of a wiring of a circuit part of the print head shown in FIG. 1.
Figure 5:
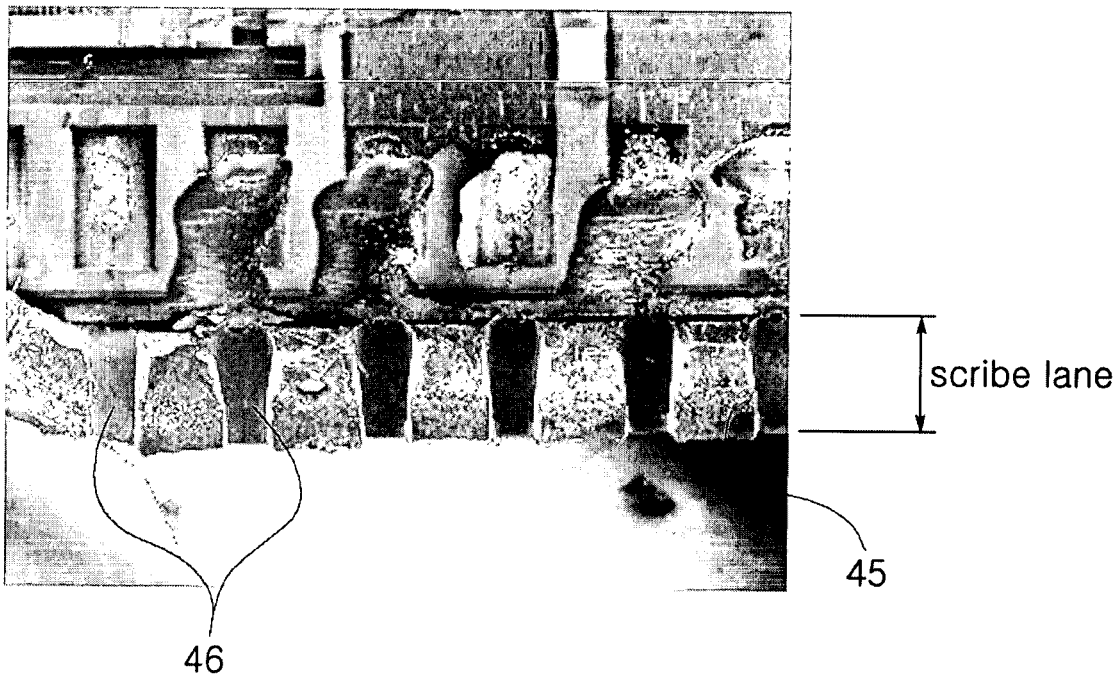
FIG. 5 (PRIOR ART)
FIG. 5 is a photograph illustrating a problem of a head chip of a print head in a conventional ink-jet printer.

The print head comprises a head chip 110 jetting ink supplied from an ink cartridge (not shown), and a circuit part (not shown) such as a flexible printed circuit board in which a wiring 131 (FIG. 10F) and/or switching circuits (not shown) are formed to control the ink jetting of the head chip 110, like the conventional print head 1 shown in FIGS. 1 and 2.

Each of the head chips 110 is divided into a main chip area 111 and a scribe lane area 115 disposed around the main chip area 111 to form a cutting region 117 in which the main chip area 111 is divided from main chip areas of other print heads by cutting.

Figure 10A:
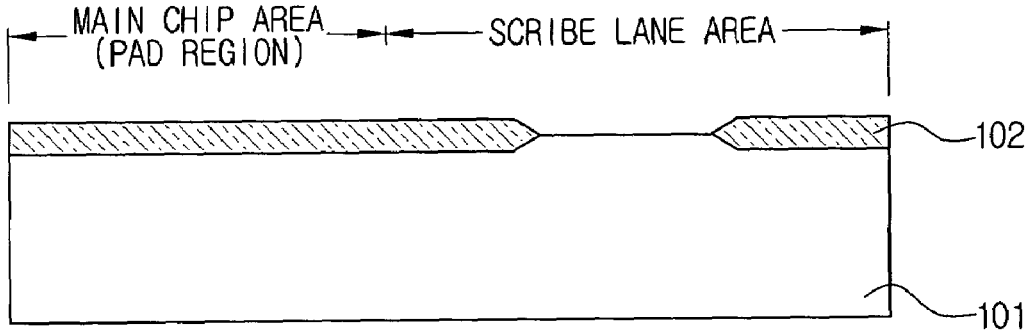
FIG. 10A through FIG. 10F are partial cross-sectional views illustrating a fabrication process of the print head of an embodiment of the present invention.
Figure 10B:
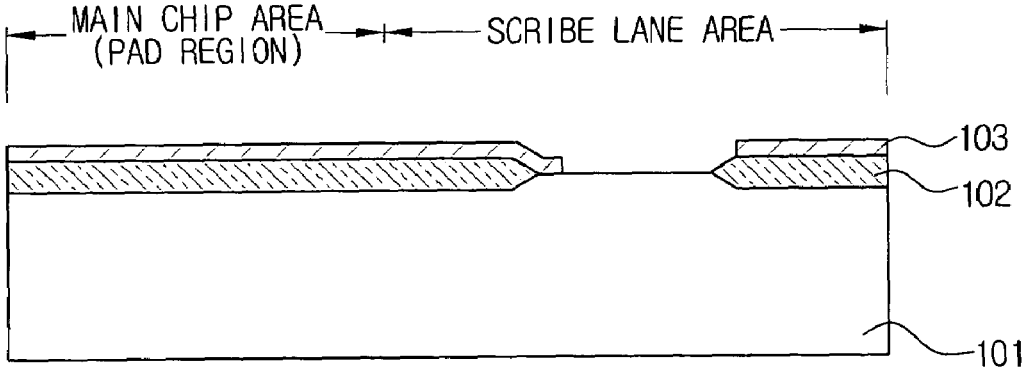
Figure 10C:
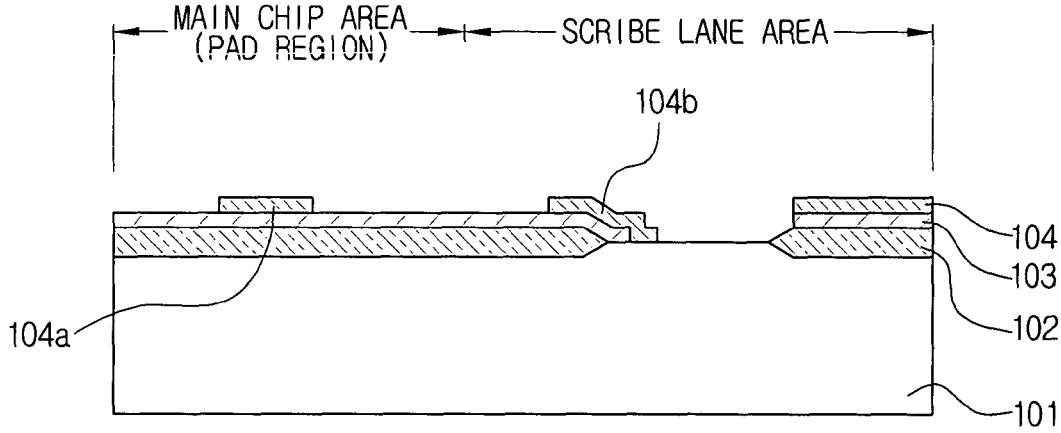
Figure 10D:
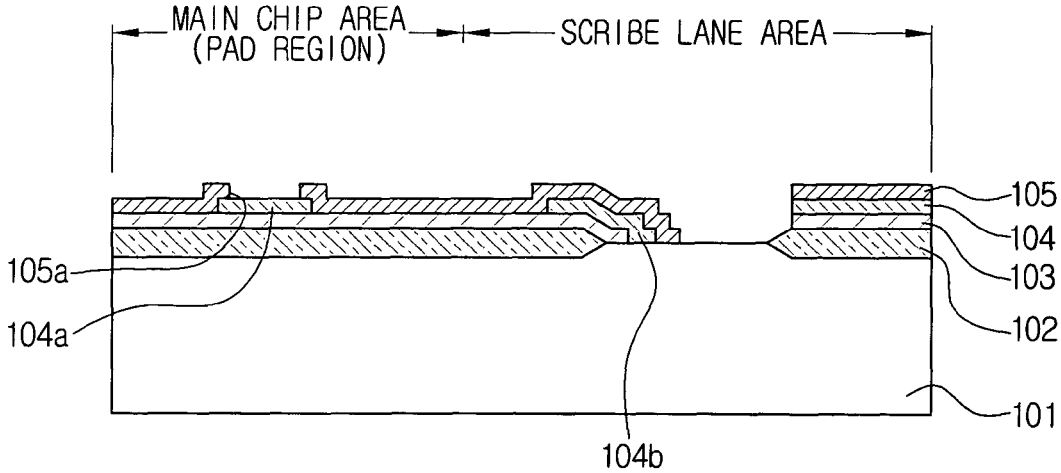
Figure 10E:
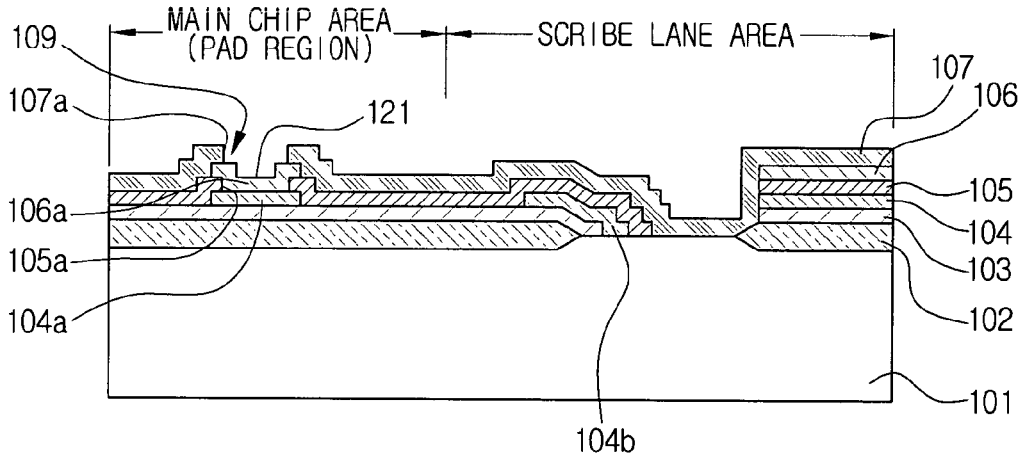
Figure 10F:
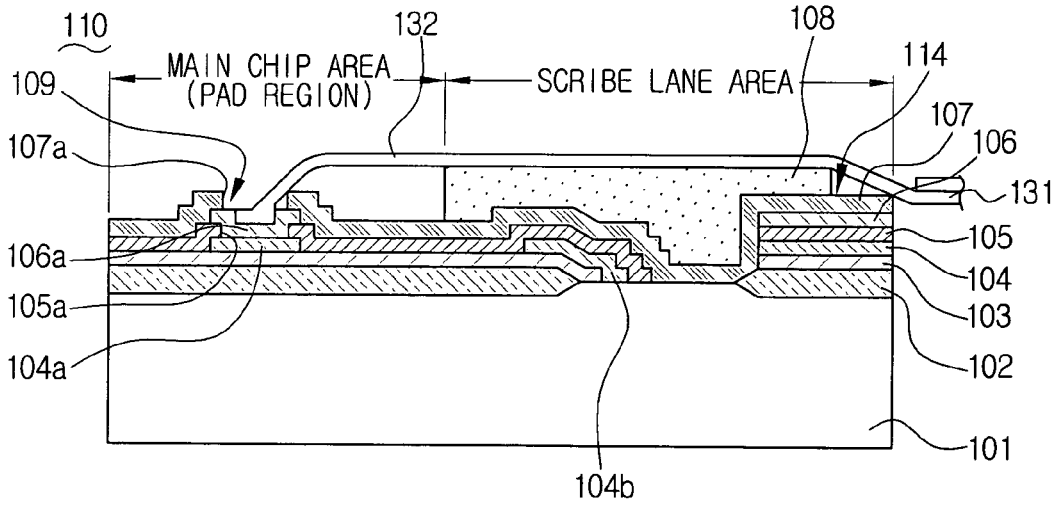

Disposed in the main chip area 111 are a plurality of ink jetting portions (not shown) to jet ink, and a plurality of bonding pads 109 connected with lead ends 132 of the wiring 131 of the circuit part and a lower wiring (not shown) at a pad region 113 to control the ink jetting portion, as shown in FIG. 10F.

Each of the ink jetting portions comprise a heater (not shown) and an ink jetting nozzle (not shown), formed on a substrate 101 (FIG. 10F), to generate ink bubbles, like the conventional print head 1 shown in FIGS. 1 and 2.

Figure 7A:
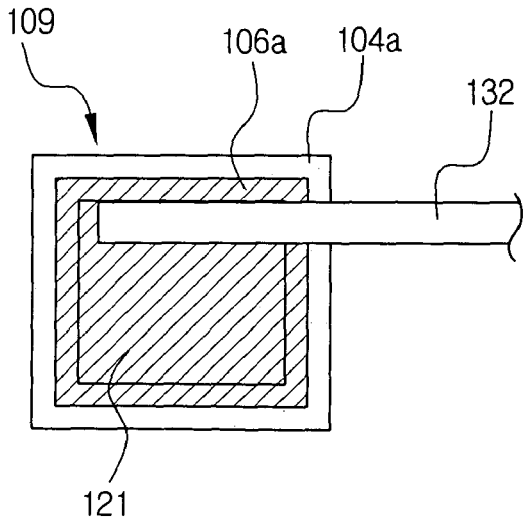
FIGS. 7A and 7B are a partial top plan view and a partial cross-sectional view illustrating a bonding state between a lead end of a wiring of a circuit part and a bonding pad of the head chip of the print head of an embodiment of the present invention.
Figure 7B:
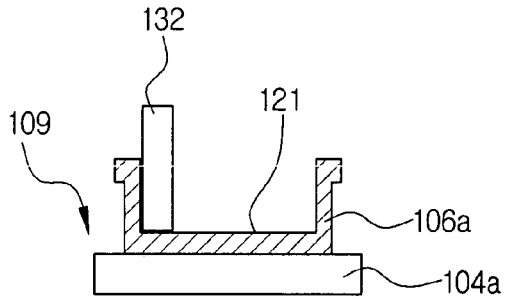

As shown in FIGS. 7A, 7B, and 10F, each of the bonding pads 109 comprises a lower metal 104*a* forming the lower wiring, and a contact plug 106*a* disposed on the lower metal 104*a* to be connected to the corresponding one of the lead ends 132 of the wiring 131 of the circuit part.

Formed on an upper surface of the contact plug 106*a* is a wide recess 121. The wide recess 121 is made due to a contact hole or a via hole 105*a* formed in an interlayer dielectric layer 105, when a metal layer is deposited on the interlayer dielectric layer 105 by sputtering and the like to form the contact plug 106*a*.

To facilitate bonding with the contact plug 106*a*, each of the lead ends 132 is bonded to be in contact with a sidewall of the wide recess 121 during piezoelectric bonding.

Thus, in the head chip 110 of the print head 1, when the lead ends 132 are piezoelectrically bonded to the bonding pads 109, the lead ends 132 can be fixedly adhered to the bonding pads 109, thereby preventing poor bonding therebetween.

Figure 8:
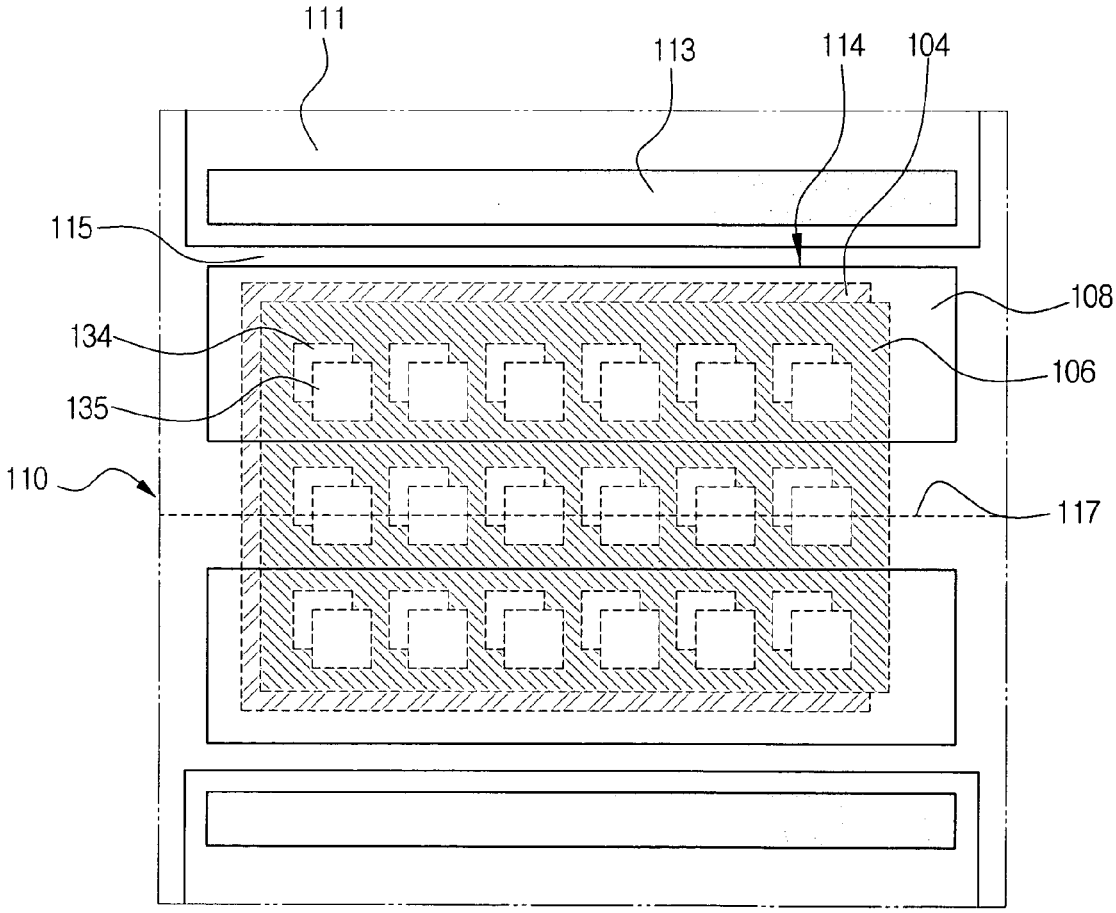
FIG. 8 is a partial top plan view illustrating a damping pattern portion of the head chip of the print head of an embodiment of the present invention.

As shown in FIGS. 8 and 10F, installed in the scribe lane area 115 of the head chip 110 is a damping pattern portion 114 formed in a shape suitable to protect, electrically and physically, the head chip 110 in the main chip area 111.

The damping pattern portion 114 has a lower reinforce pattern 104 formed of a large square or rectangle-shaped plate having a plurality of square or rectangle-shaped holes 134 disposed respectively at both sides, i.e., upper and lower sides of the head chip 110, an upper reinforce pattern 106 formed of a large square or rectangle-shaped plate having a plurality of square or rectangle-shaped holes 135 disposed partially to overlap the holes 134 of the lower reinforce pattern 104, and a second interlayer dielectric layer 105 disposed between the lower reinforce pattern 104 and the upper reinforce pattern 106 at four sides of the head chip 110, as will be described in a fabrication method of an embodiment of the present invention.

Figure 9:
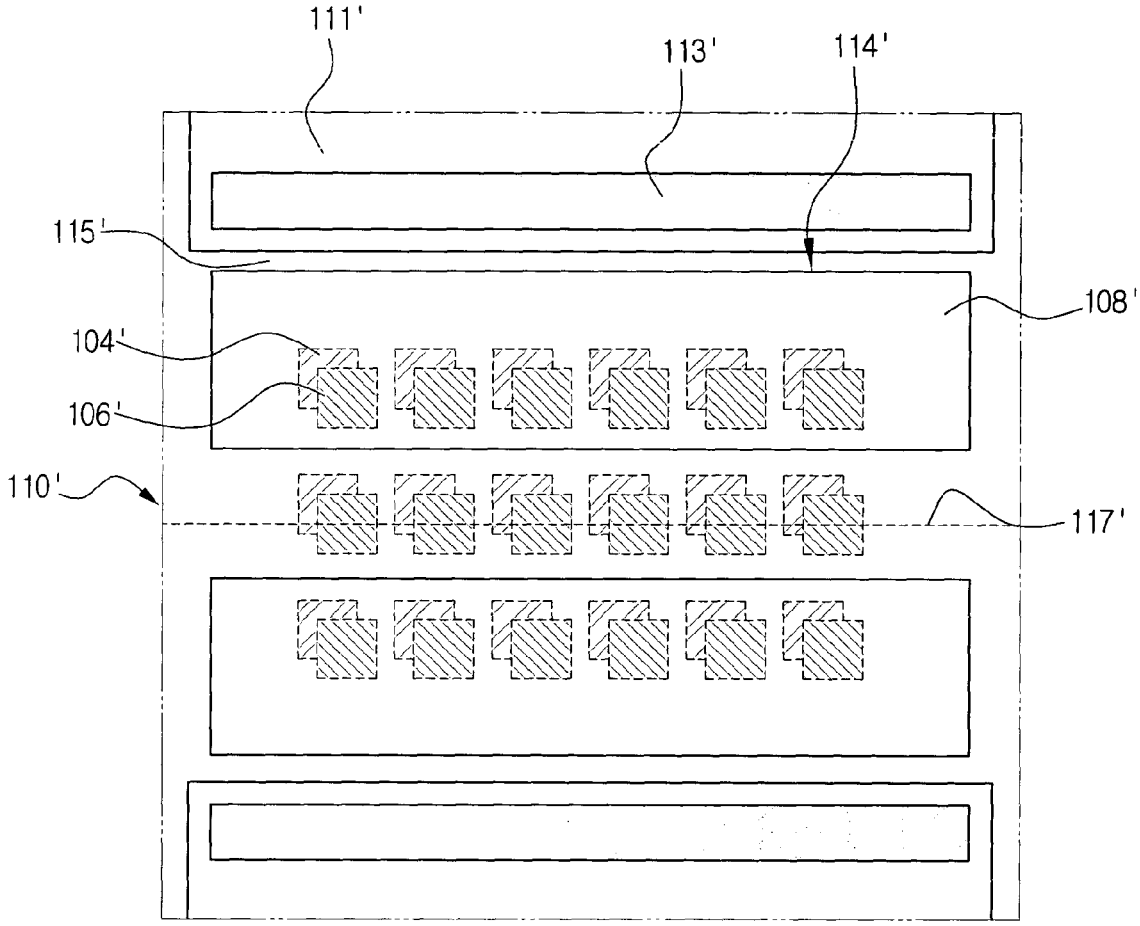
FIG. 9 is a partial top plan view illustrating a modified damping pattern portion of the head chip of the print head of an embodiment of the present invention.

Alternatively, as shown in FIG. 9, a damping pattern portion 114' can be formed to have a lower reinforce pattern 104' comprising a plurality of small square or rectangle-shaped plates disposed in rows at the upper and lower sides of the head chip 110', an upper reinforce pattern 106' comprising a plurality of small square or rectangle-shaped plates disposed in rows to overlap the small plates of the lower reinforce pattern 104', and an interlayer dielectric layer (not shown) disposed between the lower reinforce pattern 104' and the upper reinforce pattern 106' at the four sides of the head chip 110.

Even though the damping pattern portion is constructed as any one of the structures described above, the lower and upper reinforce patterns thereof 104 and 106, or 104' and 106', are formed of a conductive material, i.e., aluminum or aluminum alloy, used to form the lower wiring, and the lower metals 104*a* and the contact plugs 106*a* connected to the lower wiring at the main chip area 111, and are arranged to be electrically insulated from the lower wiring, the heaters, switching elements (not shown) such as gates (not shown) and source-drains (not shown), and the bonding pads 109, which are formed in the main chip area 111.

Also, as shown in FIG. 10F, the damping pattern portion 114 or 114' can further include an isolation layer 102 formed on the substrate 101; a first interlayer dielectric layer 103 formed of an insulator film such as a thermal oxide on the isolation layer 102; a passivation layer 107 formed on the upper reinforce pattern 106 or 106'; and a chamber/nozzle plate layer 108 formed over the upper reinforce pattern 106 or 106' at the scribe lane area 115 when it is formed at the main chip area 111 to form a chamber/nozzle plate (not shown) having ink chambers (not shown) and ink jetting nozzles (not shown).

These layers 102, 103, 107, and 108 act electrically and mechanically to insulate and reinforce the substrate 101, in cooperation with the upper and lower reinforce patterns 106 and 104, or 106' and 104'.

Thus, the damping pattern portion 114 or 114' of the present invention functions as a buffer electrically and mechanically to insulate and reinforce an outer area of the head chip 110 through the plurality of insulation or protection layers 102, 103, 107 and 108 and the upper and lower reinforce patterns 106 and 104, or 106' and 104'.

Describing it in detail, the damping pattern portion 114 or 114' can prevent a short circuit from being generated between the lead ends 132 and the substrate 101 by a compression impact occurring during printing, and when the lead ends 132 are bonded with the bonding pads 109, by providing sufficient electrical insulation between the lead ends 132 and the substrate 101, and prevent damage to the head chip 110 from being generated by a wiper or an external impact during a printing operation, including wiping, by providing sufficient mechanical strength to the head chip 110.

Also, since the lower and upper reinforce patterns 104 and 106, or 104' and 106' of the damping pattern portion 114, or 114', are formed of metal, heat generated from the head chip 110 during printing can be efficiently radiated to the ink cartridge therethrough.

In the embodiment of the present invention described above, it should be noted that the upper and lower reinforce patterns 106 and 104, or 106' and 104', of the damping pattern portions 114 or 114' are explained as disposed only with respect to the upper and lower sides of the head chip 110, but they can be also disposed at other sides of the head chip 110, as well as the upper and lower sides thereof, to enhance mechanical strength and heat radiating capacity of the head chip 110.

Also, in the above embodiment, the upper and lower reinforce patterns 106 and 104, or 106' and 104', are respectively formed of large square or rectangular plates having a plurality of square or rectangular holes, or small square or rectangle plates, but the present invention is not limited to this. For example, they may be formed of any other shape such as a large plate having a plurality of circle-shaped holes, a plurality of small circle-shaped plates, or a net or lattice-shaped plate to provide appropriate reinforce structure.

A fabrication process of an ink-jet print head in accordance with an embodiment of the present invention will now be explained with reference to FIGS. 10A through 10F.

First, as shown in FIG. 10A, an isolation layer 102 is formed of oxide on a semiconductor substrate 101, such as a silicon wafer, by a conventional isolation process, for example a local oxidation of silicon (LOCOS) process or a trench isolation process well known in the art. The isolation layer 102 defines an active region to form the switching elements, such as the gates and the source-drains, and the ink-supplying manifold (not shown) at the main chip area 111 of the head chip 110, and a ground region at the scribe lane region 115.

And then, after the switching elements are formed in the active region of the main chip area 111 in a conventional manner, a first interlayer dielectric layer 103 is formed as a protection layer on a whole surface of the substrate 101, as shown in FIG. 10B. The first interlayer dielectric layer 103 is preferably formed of an insulator film such as thermal oxide.

Thereafter, to form the lower wiring connected with the source-drains of the switching elements of the head chip 110, a lower metal layer (not shown) is deposited over the whole surface of the substrate 101 by sputtering and the like. The lower metal layer can be formed of a metal, for example aluminum or aluminum alloy, which is easy to be patterned and which has good conduction.

Subsequently, after a photo resist (not shown) is coated on the lower metal layer, it is exposed by using a lower wiring mask (not shown), and developed to form a lower wiring pattern (not shown).

Then, the lower metal layer is patterned by using the lower wiring pattern as an etching mask. As a result, the lower wiring is formed at the main chip area 111 of the head chip 110.

Also, at this time, as shown in FIG. 10C, at the pad region 113 of the main chip area 111 are formed lower metals 104*a* of bonding pads 109 which are connected to the lower wiring, and at the scribe lane area 115 are formed a lower reinforce pattern 104, and a PCT prevention pattern 104*b* which acts to protect the substrate 101 during the cutting of the head chip 110.

As shown in FIG. 8, the lower reinforce pattern 104 has a square or rectangle-shaped plate having a plurality of square or rectangle-shaped holes 134. The lower reinforce pattern 104 acts to reinforce the head chip 110, as well as to prevent a short circuit between the substrate 101 and the lead ends 132 of the wiring 131 of the circuit part, since it is insulated from the substrate 101 by the isolation layer 102 and the first interlayer dielectric layer 103.

After forming the lower wiring, the lower metals 104*a* of the bonding pads 109, and the lower reinforce pattern 104, a second interlayer dielectric layer 105, such as a tetra ethyl ortho silicate (TEOS) oxide and a CVD oxide, is formed over the whole surface of the substrate 101. The second interlayer dielectric layer 105 acts to insulate between the lower wiring and an upper wiring to be formed later, and between the lower reinforce pattern 104 and an upper reinforce pattern 106 to be formed later.

In succession, as shown in FIG. 10D, a predetermined portion of the second interlayer dielectric layer 105 is patterned by photolithography. As a result, wide contact holes, or via holes 105*a*, are formed in the second interlayer dielectric layer 105 to expose a portion of each lower metal 104*a* in the pad region 113.

After the via holes 105*a* are formed, an upper metal layer (not shown) of aluminum or aluminum alloy is deposited over the whole surface of the substrate 101 by sputtering and the like.

Thereafter, after a photo resist (not shown) is coated on the upper metal layer, it is exposed by using an upper wiring mask (not shown), and developed to form an upper wiring pattern (not shown).

Then, the upper metal layer is patterned by using the upper wiring pattern as an etching mask. As a result, as shown in FIG. 10E, contact plugs 106*a*, each of which has a wide recess 121, are formed in and around the via holes 105*a*, respectively.

Also, at this time, an upper reinforce pattern 106 is formed at the scribe lane area 115.

As shown in FIG. 8, the upper reinforce pattern 106 has a square or rectangle-shaped plate having a plurality of square or rectangle-shaped holes 135 which is disposed partially to cross the holes 134 of the lower reinforce pattern 104. The upper reinforce pattern 106 acts to reinforce strength of the head chip 110 together with the lower reinforce pattern 104, as well as to prevent a short circuit between the substrate 101 and the lead ends 132 of the wiring 131 of the circuit part, since it is insulated from the lower reinforce pattern 104 by the second interlayer dielectric layer 105.

After the upper reinforce pattern 106 is formed, heaters are formed at a corresponding active region of the main chip area 111.

At this time, the heaters are formed by sequentially depositing a metal having a relatively high specific resistance, and a metal having a relatively low specific resistance, one after another on the silicon substrate 101 and then selectively etching the metal having the relatively low specific resistance, or by forming a doped poly-silicon layer on the silicon substrate 101 and patterning it.

After forming the heaters, a passivation layer 107 is formed of a silicon nitride such as P—SiN over the whole surface of the substrate 101, and then etched to open the bonding pads 109 of the head chip 110 by using an etching mask.

Thereafter, a chamber/nozzle plate having ink chambers and nozzles is formed at the main chip area 111 by coating a chamber/nozzle plate layer 108 over the substrate 101, and then patterning it in a conventional manner. At this time, to reinforce and insulate the outer area of the head chip 110 even more, the chamber/nozzle plate layer 108 is also coated and patterned at the scribe lane area 115, as shown in FIG. 10F.

In succession, as shown in FIGS. 7A and 7B, the lead ends 132 of the wiring 131 are respectively bonded to corresponding sidewalls of the recesses 121, formed on the upper surfaces of the contact plugs 106*a* of the bonding pads 109, by piezoelectric bonding, and thereby the fabrication of the print head is completed.

As is apparent from the foregoing description, it can be appreciated that the print head and the fabrication method thereof in accordance with an embodiment of the present invention prevents a short circuit from being generated between the lead ends and the substrate by the compression impact occurring during printing and/or when the lead ends are bonded with the bonding pads, and prevents damage of the head chip in the main chip area from being generated by the wiper or an external impact during a printing operation, including wiping, by providing the damping pattern portion at the outer area of the head chip.

Further, the print head and the fabrication method thereof of an embodiment of the present invention adheres the lead ends fixedly to the bonding pads, since lead ends are bonded to be in contact with corresponding sidewalls of the wide recesses during piezoelectric bonding.

Also, the print head and the fabrication method thereof of an embodiment of the present invention efficiently removes heat generated from the head chip during printing, by providing the damping pattern portion including metal at the outer area of the head chip.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A print head of an ink-jet printer, comprising:

a main chip area having at least one ink jetting portion disposed on a substrate to jet ink, and at least one bonding pad connected with a corresponding lead end of a wiring of a circuit part to control the ink jetting portion; and a scribe lane area disposed around the main chip area and forming a cutting region in which the main chip area is divided from main chip areas of other print heads by cutting, the scribe lane area having a damping pattern portion formed to be electrically and physically isolated from the main chip area and the substrate.

2. The print head according to claim 1, wherein the damping pattern portion comprises:

at least one insulating layer formed on the substrate; and at least one reinforce pattern formed on the insulating layer.

3. The print head according to claim 2, wherein the at least one reinforce pattern comprises a plate formed in a predetermined shape and having a plurality of holes formed in a predetermined shape.

4. The print head according to claim 2, wherein the at least one reinforce pattern comprises a plurality of plates arranged in a predetermined position, each having a predetermined shape.

5. The print head according to claim 2, wherein the at least one reinforce pattern comprises a plate formed in a latticed shape.

6. The print head according to claim 2, wherein the at least one reinforce pattern is formed of a conductive material used to form lower wiring, and is arranged to be electrically insulated from the lower wiring.

7. The print head according to claim 6, wherein the conductive material is aluminum or aluminum alloy.

8. The print head according to claim 2, wherein the insulating layer comprises:

an isolation layer formed on the substrate; and a first interlayer dielectric layer formed on the isolation layer.

9. The print head according to claim 8, wherein the first interlayer dielectric layer comprises an insulator film on the isolation layer.

10. The print head according to claim 9, wherein the insulator film is a thermal oxide.

11. The print head according to claim 2, wherein the reinforce pattern comprises two reinforce patterns formed to have an interlayer dielectric layer therebetween.

12. The print head according to claim 2, wherein the reinforce pattern is formed of the same material as the bonding pad.

13. The print head according to claim 2, wherein the damping pattern portion comprises at least one protection layer formed on the reinforce pattern.

14. The print head according to claim 13, wherein the protection layer comprises:

a passivation layer formed on the reinforce pattern; and a chamber/nozzle plate layer formed on the passivation layer in the main chip area forming an ink chamber and a nozzle constituting the ink jetting portion.

15. The print head according to claim 1, wherein the damping pattern portion is disposed at both sides of the scribe lane area adjacent to a pad region of the main chip area in which the bonding pad is installed.

16. The print head according to claim 1, wherein the damping pattern portion is disposed at four sides of the scribe lane area.

17. The print head according to claim 1, wherein the lead end of the wiring is bonded with a sidewall of a recess formed on an upper surface of the bonding pad, to facilitate bonding with the bonding pad.

18. The print head according to claim 17, wherein the lead end of the wiring is bonded with the sidewall of the recess by piezoelectric bonding.

19. The print head according to claim 1, wherein the damping pattern portion is formed on various sides of the main chip area, to enhance mechanical strength and heat radiating capacity of the main chip area.

20. A head chip for an ink-jet printer, comprising:

a main chip area having at least one ink jetting portion disposed on a substrate;

a scribe lane area disposed around the main chip area and forming a cutting region in which the main chip area is divided from main chip areas of other print heads; and a damping portion on the scribe lane area of the main chip area;

wherein the damping portion electrically and physically protects the head chip in the main chip area.

21. The head chip of claim 20, wherein the damping portion comprises:

at least one insulating layer formed on the substrate; and at least one reinforce pattern formed on the insulating layer.

22. A head chip for an ink-jet printer, comprising:

a main chip area having at least one ink jetting portion disposed on a substrate;

a scribe lane area disposed around the main chip area and forming a cutting region in which the main chip area is divided from main chip areas of other print heads by cutting; and a damping portion on the scribe lane area of the main chip area;

wherein the damping portion electrically insulates and mechanically reinforces an outer area of the head chip, preventing short circuits between the substrate and wire leads coming onto the head chip.

23. The head chip of claim 22, wherein the damping portion comprises:

at least one insulating layer formed on the substrate; and at least one reinforce pattern formed on the insulating layer.

24. A head chip for an ink-jet printer, comprising:

a main chip area having at least one ink jetting portion disposed on a substrate;

a scribe lane area disposed around the main chip area and forming a cutting region; and a damping portion on the scribe lane area of the main chip area;

wherein the damping portion comprises metal, and efficiently removes heat generated from the main chip area during a printing process.

* * * * *